US005570832A

United States Patent [19]

Meier

[11] Patent Number: 5,570,832

[45] Date of Patent: Nov. 5, 1996

[54] APPARATUS FOR STAPLING SEQUENTIAL PRINTED SHEETS POSITIONED STRADDLED ONE ABOVE THE OTHER

[75] Inventor: Jörg Meier, Oftringen, Switzerland

[73] Assignee: GRAFA-Holding AG, Hergiswil, Switzerland

[21] Appl. No.: 258,834

[22] Filed: Jun. 13, 1994

[30] Foreign Application Priority Data

Jun. 21, 1993 [CH] Switzerland ..... 01859/93

[51] Int. Cl.[6] ..... B42B 4/02; B27F 7/17

[52] U.S. Cl. ..... 227/81; 227/82; 227/87

[58] Field of Search ..... 227/81, 82, 85, 227/89, 90, 97, 87

[56] References Cited

U.S. PATENT DOCUMENTS

| | | | |
|---|---|---|---|
| 2,026,135 | 12/1935 | Meyer | 227/81 |
| 2,224,743 | 12/1940 | Nolan | 227/81 |
| 3,040,324 | 6/1962 | Worthington et al. | 227/81 |
| 3,223,304 | 12/1965 | Chaffee et al. | 227/81 |
| 3,653,570 | 4/1972 | Alsop | 227/81 |
| 4,850,520 | 7/1989 | Schumann et al. | 227/81 |
| 5,342,032 | 8/1994 | Meier | 227/81 |

FOREIGN PATENT DOCUMENTS

| | | |
|---|---|---|
| 0399317 | 11/1990 | European Pat. Off. . |
| 1291724 | 4/1969 | Germany . |
| 667621 | 10/1988 | Switzerland . |
| 519247 | 4/1940 | United Kingdom . |

*Primary Examiner*—Scott A. Smith
*Attorney, Agent, or Firm*—Spencer & Frank

[57] ABSTRACT

An apparatus for stapling printed sheets includes a conveying apparatus having a plurality of sequentially spaced, saddle-shaped supports. The printed sheets straddle the sequentially spaced supports. A shaping body is rotatingly disposed on a first axis, and receives and conveys a wire segment. A stapling head holder is rotatingly driven about a second axis parallel to the first axis. At least one stapling head is radially displaceably seated in a guide arrangement on the stapling head holder. The stapling head has a bending apparatus having an end with an opening forming a guide. The opening is penetrated by the shaping body for receiving the wire segment from the shaping body, and shaping the wire segment into a staple. The stapling head further has a driver that forces the staple through the printed sheets positioned on the supports. The driver and the staple are guided by the guide formed by the opening of the bending apparatus.

17 Claims, 3 Drawing Sheets

APPARATUS FOR STAPLING SEQUENTIAL PRINTED SHEETS POSITIONED STRADDLED ONE ABOVE THE OTHER

CROSS-REFERENCE TO RELATED APPLICATION

This application claims the priority of patent application Ser. No. CH 01859/93-0, filed Jun. 21, 1993, in Switzerland, the subject matter of which is incorporated herein by reference.

BACKGROUND OF THE INVENTION

1. Field of the Invention

The invention relates to a method for stapling sequential printed sheets positioned straddled one above the other on supports of a conveying apparatus and stapled on a stapling segment by stapling heads that rotate in tracks above the supports and cooperate with a bending apparatus with wire staples made of an endless wire. The invention further relates to an apparatus for executing the method for stapling printed sheets gathered straddled one above the other on supports of a conveying apparatus following one another with spacing, the apparatus comprising at least one stapling head pair that rotates in tracks above the supports and cooperates with the latter and a bending apparatus; the stapling head pair is configured by a bending apparatus that shapes a supplied wire segment into a staple, and a driver that forces the staple through the gathered printed sheets.

2. Description of the Related Art

An apparatus of this type is disclosed in, among other publications, CH-A-667,621. This apparatus includes a rotary stapler, in which the printed products are positioned by means of positioning stations to straddle the gathering segments disposed symmetrically around a rotational axis, and conveyed by carriers along the gathering segments to a work region of a stapling apparatus. The stapling heads of the stapling apparatus are allocated to the gathering segments, so that on every gathering segment loaded with printed products, stapling can take place at the end of the gathering region; to execute the stapling process, stapling apparatuses are used in which stapling heads coupled with gathering segments rotate, and are actuated to staple by stationary cam tracks, or in which the stapling heads are driven to be actuated to be driven over a martial region of the circumference of the drum-shamed gathering apparatus formed by the gathering segments.

As an alternative to this embodiment of rotating stapling heads, CH-A-667,621 discloses a stapling apparatus in which the rotational axis of the stapling heads is provided at a distance from or outside of the gathering segments disposed in a drum configuration.

The same applies for EP-A-0,399,317.

Rotary staplers of this type have a compact design; however, they are, not least of all because of their narrow design, susceptible to interferences that processing and make eliminating the pauses relatively time-consuming due to a lack of simple overview and accessibility.

SUMMARY OF THE INVENTION

The present invention is intended to eliminate these drawbacks and be used to achieve reliable production of stapled printed products that meet high quality standards.

This is accomplished in accordance with the invention in that the endlessly supplied wire is processed into wire segments on a driven shaping body by a cutting apparatus, and are delivered as staples from the shaping body to the rotating staple heads under the effect of form-fitting shaping.

The apparatus of the invention for executing the method is distinguished in that the stapling heads, which can be driven in a controlled manner, are radially displaceably seated in a guide arrangement of a rotatingly driven stapling head holder, and that the bending apparatus is provided at the end that takes over the wire segment with an opening to be penetrated by a shaping body seated on a parallel axis; this opening is configured as a guide for the staple and the driver.

This construction permits the staple made of a relatively thin wire to be processed in a gentle manner in high-output production.

Furthermore, in accordance with the invention it is possible to meet this structural requirement with an alternative embodiment.

The bending apparatus and the driver are advantageously connected to be driven with stationary cam tracks, with the stroke-like movement of the bending apparatus being provided particularly to achieve a common stapling segment of the supports of the conveying apparatus, whereas the cam track of the driver is used to provide its stroke-like movement during stapling.

It is recommended that the bending apparatus be formed by the guide for the staple and the driver to be slot-shaped or fork-shaped, respectively, and guided form-fittingly on the stapling head holder.

A circular, disk-like shaping body or star-shaped rotor that penetrates into the opening of the bending apparatus with the edge formed at the circumference is particularly suited for forming a staple.

A shaping body that has carriers distributed at its circumference for taking over the wire segments has proven particularly advantageous with respect to the load reliability of the carriers and delivery of the wire segments to the bending apparatus.

To be able to deliver the wire segments to the bending apparatus, the stapling heads and the shaping body, or the bending apparatus and the carriers allocated thereto, respectively, have at least approximately the same direction of movement in the region of proximity.

A further improvement in the position of the wire segments on the carriers that has been specified for shaping can be achieved by grooves for receiving the wire segments, the grooves being in the direction of rotation, with which a certain imprecision in the position of the wire segment can be compensated by a V-shaped configuration of the groove.

In place of a possible magnetization of the groove bottom, the groove is configured to be broken up in its length, so that a controlled jaw part can hold the wire segment securely in the intermediate space.

The spacing between two grooves or carriers at the circumference of the shaping body approximately corresponds to the length of at least one cadence from the time the wire segment is taken over at a cutting apparatus for the wire to the point of delivery of the wire segment to the bending apparatus, i.e., the stapling heads and the shaping body have approximately the same rotational speed in the region of their proximity.

So that the cutting apparatus can take over the wire segments in a gentler manner, a stepping drive is preferably connected to the shaping body. This drive has a decelerating effect on the carrier speed prior to the takeover of the wire segments, and also ensures that the rotational speed is likewise reduced at the point of delivery of the staple to the bending apparatus, which releases the engagement between the bending apparatus and the carrier.

A stepping drive also permits the acceleration of the shaping body following the takeover of the wire segment until it is delivered to the bending apparatus, as well as the slowed drive of the carriers on the remainder of the path.

To permit the staple that has been shaped by the bending apparatus and the shaping body and remains on its front side in guide grooves of the driver to pass through only a short path to the stapling segment, the shaping body is disposed beneath a horizontal plane defined by the rotational axis of the stapling heads, that is, the shaping bodies allocated to a stapling head pair have a common rotational axis.

In connection with multiple stapling of a printed product, four wires are supplied, for example, by means of which it appears advantageous with respect to accessibility and reliability if the shaping bodies respectively associated with the stapling head holders are disposed distributed at the circumference of the common rotational circle.

To avoid unnecessary tolerances and adjustment work, the shaping body or bodies is/are connected to be driven with the stapling heads.

In connection with processing the wire segments, it is particularly advantageous in the sense of a simple configuration and compact design if the grooves of the carries of the shaping body are connected to the respective cutting location of a cutting apparatus for the wire supplied from a feeding apparatus.

BRIEF DESCRIPTION OF THE DRAWINGS

These and other features and advantages of the invention will be further understood from the following detailed description of the preferred embodiment with reference to the accompanying drawings in which.

DETAILED DESCRIPTION OF THE PREFERRED EMBODIMENT

Figure 1:
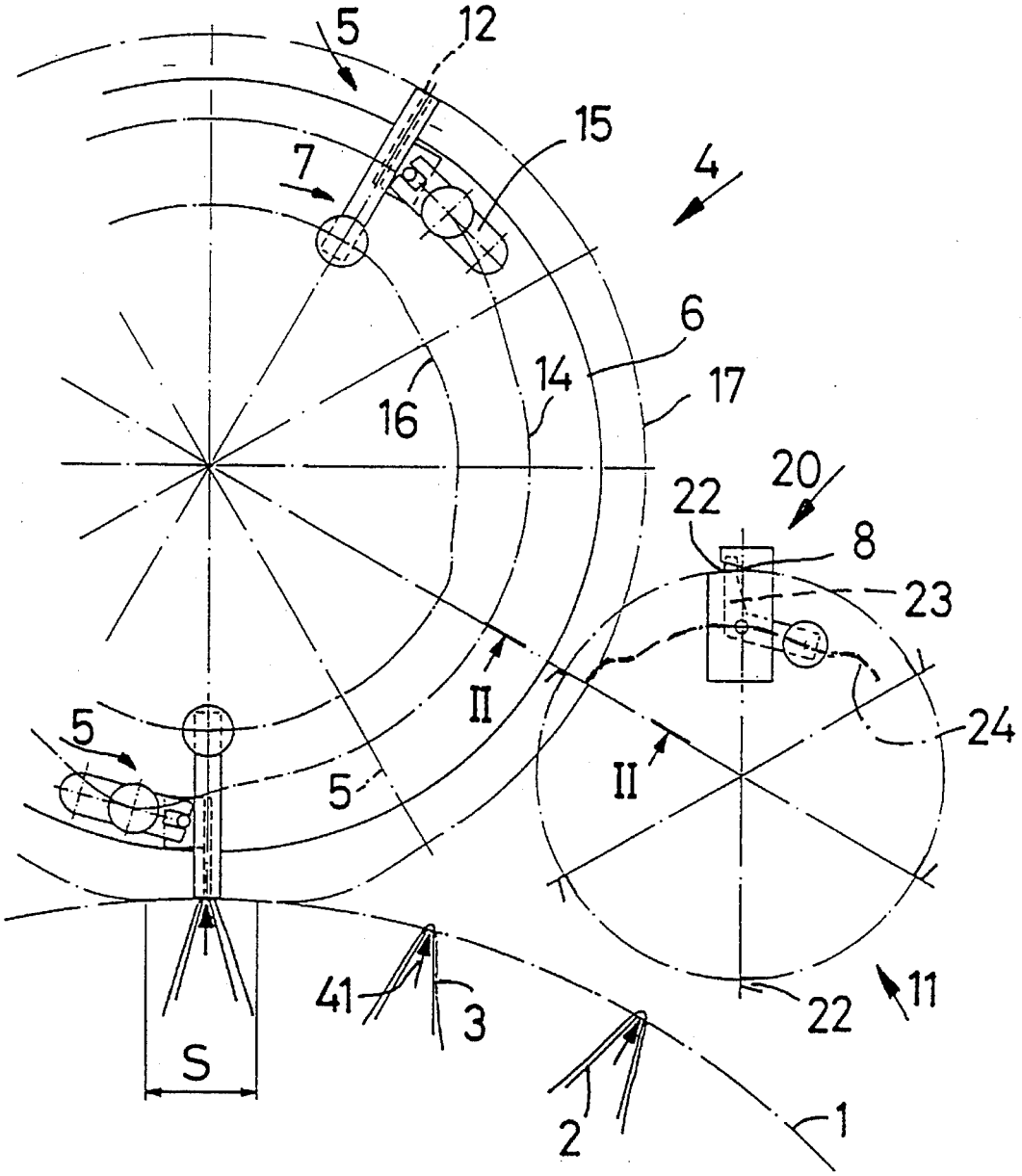
FIG. 1 shows a schematic representation of the arrangement of the apparatus of the invention for stapling gathered printed sheets.

FIG. 1 is a sectional view of a conveying apparatus 1 on which supports 2 for gathering printed sheets 3 are provided with spacing and transversely to the conveying apparatus. The gathered printed sheets are transported by means of conveying apparatus 1 from a loading region (not visible) comprising a plurality of feeding stations into the stapling region of a stapling apparatus 4. This apparatus comprises a plurality of stapling heads 5 that rotate on circular tracks and are secured and distributed at the circumference of a rotatingly driven stapling head holder 6; in the present embodiment, stapling apparatus 4 respectively has stapling head holders or stapling heads which are disposed in pairs on an axis, spaced axially from one another and provided for effecting dual stapling.

Stapling heads 5 cooperate with benders 41 allocated to them along a stapling segment S, on which the stapling process is executed. These benders are respectively located beneath the saddle of the supports, and can be connected therewith or secured to an apparatus operating separately but synchronously therewith.

Stapling heads 5 in turn have a bending apparatus 7 for shaping a supplied wire segment 8 into a staple, and a driver 9 (FIG. 2) for forcing the staple through the folded edges of the printed sheets 3, which are lying one on top of the other.

For this purpose, stapling heads 5 are seated to be radially displaceable back and forth in a guide arrangement provided on staple carrier(s) 6, and, at the end that takes over wire segment 8 and projects beyond the circumference of stapling head holder 6, bending apparatus 7 has an opening 12 to be penetrated by a shaping body 11 seated on a parallel axis. This opening 12 is further configured as a guide 13 for both the shaped staple and the driver 9 facing the back of the staple.

Figure 2:
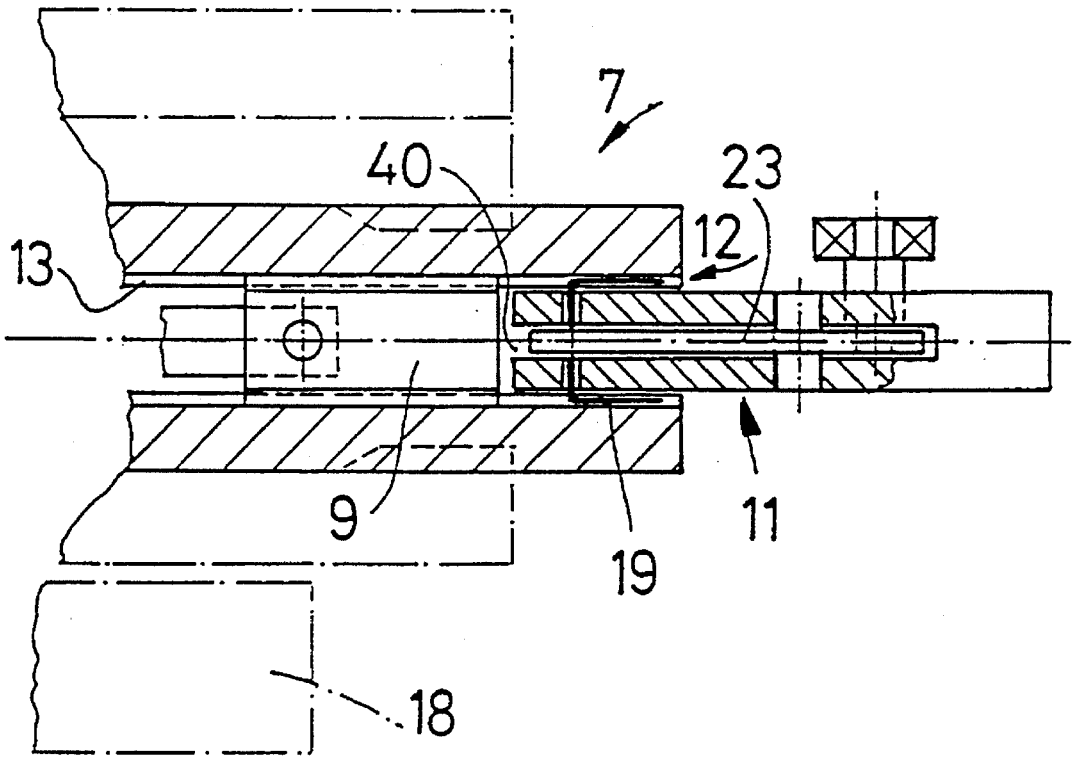
FIG. 2 shows a section along line II—II in FIG. 1.

FIG. 2 shows further details of the embodiment of stapling head 5. Driver 9 has the shape of a longitudinally-extending plate, and is supported laterally to glide in guide 13. Its actuation is effected by means of a pivot lever 15 guided in a stationary cam track 14 (FIG. 1).

The bending apparatus 7 forming the guide 13 of driver 9 is likewise moved radially back and forth by a stationary cam 16, i.e., it serves in lowering against supports 2 in order to fix printed sheets 3 immediately before stapling, where each stapling head 5 or bending apparatus 7, respectively, and supports 2 or the benders together form a stapling segment S; on the other hand, a favorable engagement or penetration angle can be attained through a backward displacement of bending apparatus 7 when it encounters shaping body 11.

A stapling segment S can be produced along the rotational circle both when stapling head 5 is retracted and when a stapling head 5 is raised above the rotational circle. The special configuration of stapling segment S is, however, not the subject of this invention.

As already explained, fork-shaped bending apparatus 7 is guided form-fittingly on rotating stapling head holder 6 and driven to oscillate by a cam 16 disposed in a fixed shield 18.

From the illustrated position, wire segment 8 is transferred at the required length from shaping body 11 to bending apparatus 7, and simultaneously pre-shaped into a C-shaped staple 19, i.e., a circular disk (or a star-shaped rotor, not shown) penetrates, with the edge at the circumference, through guide 13 formed by opening 12 in bending apparatus 7.

Figure 3:
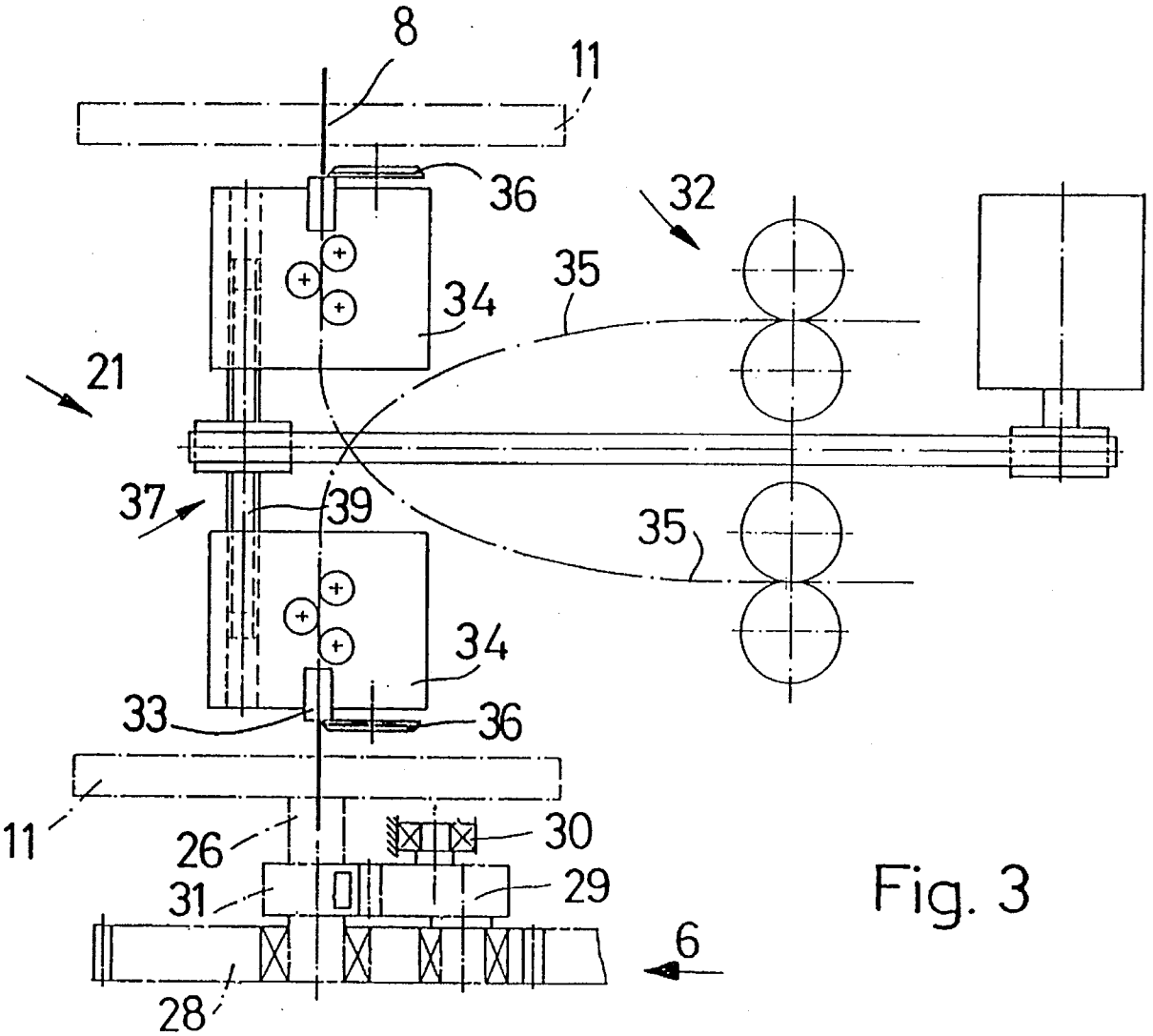
FIG. 3 shows a top view according to arrow III in FIG. 1.

For this purpose, shaping body 11 is configured with carriers 20 distributed at the circumference; these carriers take over wire segment 8, which projects on both sides from shaping body 11, from a cutting apparatus 21 (FIG. 3).

At the point of passage into bending apparatus 7, bending apparatus 7 and carrier 20 guiding wire segment 8 have at least approximately the same rotational speed, so that wire segment 8 is shaped into a staple 19 via opening 12 of bending apparatus 7. During this process, staple 19, with its back oriented toward the front edge of driver 9, reaches the guide in which driver 9 subsequently lies against the back of the staple, i.e., once carrier 20 has left guide 13.

To improve the engagement of wire segments 8 on cutting apparatus 21 (FIG. 3) by carriers 20, carriers 20 are formed by grooves 22 which are open in the direction of movement or rotation; more precise positioning of wire segment 8 on carrier 20 is achieved through an increasing narrowing of groove 22, and through the coincidence with opening 12 of bending apparatus 7 can thus be simplified.

A jaw part 23 that is pivotably seated on shaping body 11 and connected at the one end to a control track 24 is provided as holding means for wire segments 8. In order to securely clamp the wire segments, the other end of jaw 23 can be pivoted into the intermediate space resulting from an interruption in the grooves in the longitudinal direction.

The spacing between two carriers 20 or grooves 22, respectively, at the circumference of shaping body 11 corresponds to the length of a time segment from the takeover of wire segment 8 at cutting apparatus 21 until the segment is delivered to bending apparatus 7, i.e., wire segments 8 can also be, for example, supplied to the one shaping body 11 in one or a plurality of staggered cadence intervals.

A stepping drive may be seated on shaft 26 of shaping body 11, and assures a short-term reduction or increase in the speed of carriers 20 prior to or following takeover of wire segments 8, and for separating carriers 20 from bending apparatus 7 following the delivery of wire segments 8 to stapling head 5 or bending apparatus 7, as described.

The drive of shaping body 11 is effected from stapling head holder 6 via a toothed wheel 27 on pinion 28, which is seated to rotate freely on shaft 26. A driving toothed segment 29 is pivotably seated on this pinion 28, on the side facing the one shaping body 11, and has a control roller 30 that lies against a sliding control member (not visible). Moreover, driving toothed segment 29, which is actuated by control roller 30, engages a toothed segment 31 that is connected to shaft 26 via a wedge. Hence, a rigid, driving connection exists between stapling head(s) 5 secured to stapling head holders 6 and shaping body (bodies) 11, which are influenced with respect to speed by the effect of the sliding control member on control roller 30, that is, the sliding control member has a short-term decelerating or accelerating effect on shaping bodies 11 or carriers 20.

The stepping drive can be omitted in a special configuration of carriers 20, or by means of a pivoting movement of bending apparatus 7.

In FIG. 1, at least one of the shaping bodies 11 associated with stapling heads 5 secured in pairs on two stapling head holders 6 is disposed beneath a horizontal plane defined by the rotational axis of stapling heads 5 or stapling head holder 6, that is, if the number of staplings to be performed on the back of a product exceeds two, it could be advisable to dispose shaping bodies 11 distributed at the common circumference of rotational circle 17 of stapling head holders 6 in order to have more usable space for wire guidance.

In FIG. 3, cutting apparatus 21 comprises two cutting elements 34, to each of which a wire 35 is allocated that is conveyed from an upstream feeding apparatus 32. Wire 35 is guided via a roller guide through a nozzle-like wire leadthrough 33 to the cutting location, which is formed by the exit opening of wire leadthrough 33 and disk-like blade 36.

The drive of blade(s) 36 coincides with shaping bodies 11 or carriers 20, respectively, or grooves 22, i.e., the wire 35 periodically pushed out of wire leadthrough 33 and specified for shaping into a staple is taken over at least nearly simultaneously by carriers 20 and cut into a wire segment 8. The length of wire segments 8 is determined by a spindle drive 37 that has a regulating effect on cutting elements 34; a motor 38 acts on a spindle 39 equipped with a left thread and a right thread and connected to be driven with cutting elements 34.

Of course, it is possible to dispose cutting elements 34 in such a manner that the right or left thread on spindle 39 can be used.

It will be understood that the above description of the present invention is susceptible to various modifications, changes and adaptations, and the same are intended to be comprehended within the meaning and range of equivalents of the appended claims.

What is claimed is:

1. An apparatus for stapling printed sheets, comprising:

a conveying apparatus having a plurality of sequentially spaced, saddle-shaped supports, the printed sheets straddling said sequentially spaced supports;

a shaping body rotatingly disposed on a first axis, and receiving and conveying a wire segment;

a stapling head holder rotatingly driven about a second axis parallel to the first axis; and at least one stapling head radially displaceably seated in a guide arrangement on said stapling head holder, and having:

a bending apparatus having an end with an opening forming a guide, the opening being penetrated by said shaping body for receiving the wire segment from said shaping body, and shaping the wire segment into a staple; and a driver that forces the staple through the printed sheets positioned on the supports, said driver and said staple being guided by the guide formed by the opening of said bending apparatus.

2. A stapling apparatus according to claim 1, wherein the bending apparatus and the driver are connected to be driven with stationary cams.

3. A stapling apparatus according to claim 2, wherein the guide for the staple and the driver is fork-shaped, said bending apparatus being disposed on the stapling head holder to be guided by the guide arrangement in a form-fitting manner.

4. A stapling apparatus according to claim 1, wherein the shaping body is a circular disk having an edge at a circumference of the shaping body that penetrates the opening of the bending apparatus.

5. A stapling apparatus according to claim 4, wherein the stapling head and the shaping body have approximately a same direction of movement and speed in a region of their proximity.

6. A stapling apparatus according to claim 5, wherein the shaping body is connected to be driven with the stapling head holder.

7. A stapling apparatus according to claim 4, wherein the shaping body has carriers distributed in sectors at the circumference of the shaping body.

8. A stapling apparatus according to claim 7, wherein each carrier is formed by a groove for receiving the conveyed wire segment, the groove being open in the direction of rotation of the shaping body.

9. A stapling apparatus according to claim 8, the carrier further comprising a jaw part which pivots inwardly toward the axis of the shaping body for holding the wire segment.

10. A stapling apparatus according to claim 8, wherein the groove of the carrier conveys the conveyed wire segment from a cutting apparatus that forms the conveyed wire segment from supplied wire.

11. A stapling apparatus according to claim 7, wherein spacing between two carriers at the circumference of the shaping body corresponds to a length of a time between when the conveyed wire segment is received by a carrier and when the wire segment is received by the bending apparatus.

12. A stapling apparatus according to claim 11, further comprising a drive assembly coupled to the shaping body, the drive assembly having an accelerating and decelerating effect on a carrying speed of the shaping body prior to and following, respectively, the wire segment being received by the bending apparatus.

13. A stapling apparatus according to claim 12, wherein the drive assembly includes a driving wheel rotatably seated on a shaft, a toothed segment seated securely on the shaft, and a driving segment disposed laterally from the driving wheel and on an axis which is parallel to an axis of the driving wheel, the driving segment being pivotably controlled and meshing with the toothed segment.

14. A stapling apparatus according to claim 13, wherein the toothed segment is a control roller connected with a control track that surrounds the shaft.

15. A stapling apparatus according to claim 4, wherein the shaping body is disposed beneath a horizontal plane defined by a rotational axis of the stapling head pair.

16. A stapling apparatus according to claim 4, wherein the shaping body is disposed at a circumference of a common rotational circle of the stapling head.

17. A stapling apparatus according to claim 1, wherein the shaping body has an edge at a circumference thereof that penetrates the opening of the bending apparatus.

* * * * *